US005444458A

United States Patent [19]

Ishikawa

[11] Patent Number: 5,444,458

[45] Date of Patent: Aug. 22, 1995

[54] DISPLAY DATA WRITE CONTROL DEVICE

[75] Inventor: Ryo Ishikawa, Akigawa, Japan

[73] Assignee: Casio Computer Co., Ltd., Tokyo, Japan

[21] Appl. No.: 198,610

[22] Filed: Feb. 18, 1994

[30] Foreign Application Priority Data

Feb. 22, 1993 [JP] Japan ..... 5-031949

[51] Int. Cl.[6] ..... G09G 3/36; G09G 5/14

[52] U.S. Cl. ..... 345/98; 345/119

[58] Field of Search ..... 345/38, 98, 113–116, 345/119, 120, 201

[56] References Cited

U.S. PATENT DOCUMENTS 5,241,304 8/1993 Munetsugu et al. ..... 345/98

*Primary Examiner*—Jeffery Brier

*Attorney, Agent, or Firm*—Frishauf, Holtz, Goodman, Langer & Chick

[57] ABSTRACT

A system memory in the electronic device has a display data memory area, and when a CPU accesses directly to the system memory, the liquid crystal display control section (LCDC) monitors whether or not address data is directed to the display data memory area. In the case where the address data associated with display data is directed to the display memory area, the LCDC also sends the display data and the address data to the display driving circuit. The display driving circuit comprises a VRAM, in which the display data is stored in a predetermined memory location in accordance with the received address data, and the stored data is displayed on the LCD.

18 Claims, 3 Drawing Sheets

DISPLAY DATA WRITE CONTROL DEVICE

BACKGROUND OF THE INVENTION

1. Field of the Invention

The present invention relates to a control device for writing display data in a memory, which is used, for example, in an electronic device having a liquid crystal display section.

2. Description of the Related Art

FIG. 5 is a diagram showing the structure of a conventional display control device having a display video memory (VRAM) in a system memory. The system memory 13 is connected to a central processing unit (CPU) 11 via data and address bus 12, and also segment display drivers ($D/D_{SEG}$) 15*a* and 15*b* of a dot matrix liquid crystal display 14 are connected to the CPU 11.

The CPU 11 includes a liquid crystal display control section 11*a*, control signals from which are supplied to the system memory 13, $D/D_{SEG}$ 15*a* and 15*b*, as well as to a common display driver ($D/D_{COM}$) 16.

In the conventional display control device shown in FIG. 5, the VRAM 13*a* is provided in the system memory 13, and the VRAM 13*a* in the system memory 13 is directly accessed by the CPU 11 for writing/reading of data to be displayed. Therefore, the software burden can be reduced. However, while data is displayed on the LCD 14, the display data in the VRAM 13*a* must be transferred at all times to the $D/D_{SEG}$ 15*a* and 15*b*, and therefore when the number of display pixels is increased, the data transfer amount, that is, the number of times of data access to the VRAM 13*a*, is accordingly increased, resulting in consuming a great amount of current.

FIG. 6 is a diagram showing the structure of another conventional display control device comprising a display video memory (VRAM) in a display driver chip. As shown in the figure, a system memory 23, a liquid crystal display section 24, and segment display drivers ($D/D_{SEG}$) 25*a* and 25*b* are connected to a CPU 21 via data and address bus 22.

Display data and a write control signals for VRAMs 26*a* and 26*b* respectively provided in the $D/D_{SEG}$ 25*a* and 25*b* are supplied to the $D/D_{SEG}$ 25*a* and 25*b* from the CPU 21, and a display timing signal from a liquid crystal display control section (LCDC) 27 provided in the $D/D_{SEG}$ 25*a* is supplied to the $D/D_{SEG}$ 25*b* and a $D/D_{COM}$(common display driver) 28.

More specifically, in the conventional display control device shown in FIG. 6, while data is displayed on the LCD 24, a segment of the LCD 24 is driven directly by the bit pattern data written in the VRAMs 26*a* and 26*b* in the $D/D_{SEG}$ 25*a* and 25*b*, and therefore even if there are a great number of display pixels, the number of times of data access with respect to the CPU 21 can be kept small. Further, since a multi-bit output memory can be used as a memory for display, the current consumed can be made small.

However, when the number of system buses 22 from the CPU 21 to the $D/D_{SEG}$ 25*a* and 25*b* is reduced in designing for the purpose of the downsizing of device, the accessing of the CPU 21 to the $D/D_{SEG}$ 25 in terms of processing of command, address and display must be carried out by software control. As a result, this display control device entails the problem of a heavy software designing burden as compared to the conventional display control device comprising the VRAM in the system memory, shown in FIG. 5.

In short, one type of the conventional display control devices has the problem of a large consuming current due to the data access to the VRAM 13*a* in the system memory, and the other type has the problem of a heavy software burden due to the data access with respect to the CPU 21.

SUMMARY OF THE INVENTION

The present invention has been proposed in consideration of the above problems, and the object thereof is to provide a display control device in which the software designing burden in order for storing display data output from the CPU into the display memory, can be reduced.

According to the present invention, there is provided an electronic device comprising: a dot matrix type display screen; a display driving circuit for driving the display screen; a process unit for controlling operation of the electronic device; a system memory having a memory area directly address-controllable by the process unit and containing a display memory area; and a display data write control circuit, included in the process unit, for detecting display data written from the process unit to the display memory area of the system memory, and transferring the display data to the display driving circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF A PREFERRED EMBODIMENT

An embodiment of the present invention will now be described with reference to drawings.

Figure 1:
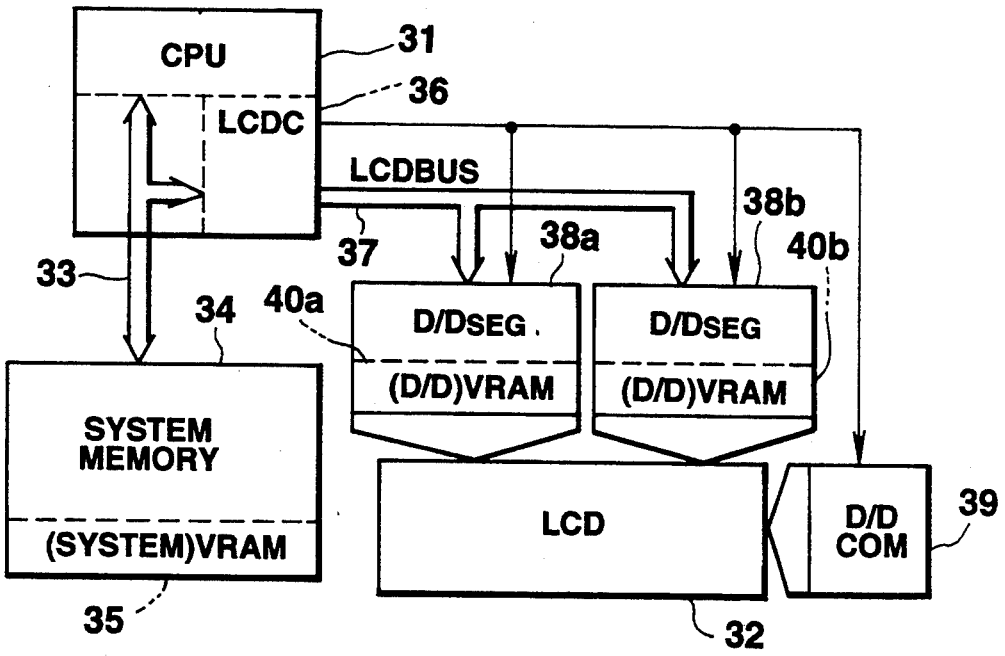
FIG. 1 is a block diagram showing the structure of a display control device according to one embodiment of the present invention.

FIG. 1 is a block diagram showing the structure of a display control device of the embodiment according to the present invention.

A central processing unit (CPU) 31 serves to generate display data to a liquid crystal dot matrix display section (LCD) 32, and control the operation of each section of the device. To the CPU 31, a system memory 34 is connected via system bus 33 including data bus and address bus.

The system memory 34 comprises a video memory (VRAM) 35, in which display data transferred from the CPU 31, which is to be displayed on the LCD 32, is stored.

Inside the CPU 31, there is provided a liquid crystal display control section (LCDC) 36 connected to the system bus 33. Display data and the address data thereof output from the LCDC 36 are transferred to segment display drivers ($D/D_{SEG}$) 38*a* and 38*b* via a liquid crystal display bus (LCDBUS) 37, whereas a display control signal output from the LCDC 36 is supplied to the $D/D_{SEG}$ 38*a* and 38*b* and a common display driver ($D/D_{COM}$) 39.

The $D/D_{SEG}$ 38*a* and 38*b* comprise display VRAMs 40*a* and 40*b*, respectively, and the LCD 32 is driven in accordance with the display data written in the display VRAMs 40*a* and 40*b* as a bit map pattern.

Figure 2:
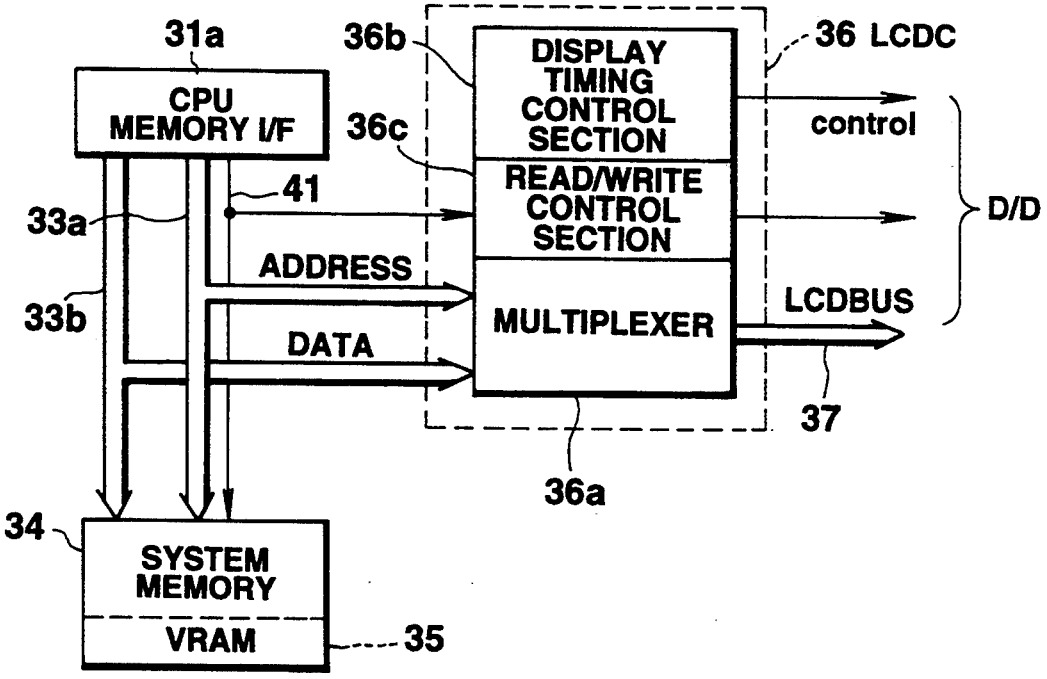
FIG. 2 is a block diagram showing details of a liquid crystal display controller shown in FIG. 1.

FIG. 2 shows a section related to the LCDC 36 in the display control device. The address bus 33*a*, data bus 33*b*, and a R/W (read/write) control signal line 41 from a memory interface section 31*a* of the CPU 31 are connected to the system memory 34 and the LCDC 36 in a similar manner.

The LCDC 36 operates such that the display and address data is fetched in the multiplexer 36*a* when data is written from the CPU 31 to the system memory 34, and it is judged as to whether or not the data is to be written in the VRAM 35 of the system memory 34 on the basis of the address data. When the display data is to be written in the VRAM 35, the display data and the address data thereof fetched in the multiplexer 36*a* are transferred to the $D/D_{SEG}$ 38*a* and 38*b* in order via the LCDBUS 37 in the time divisional manner.

Figure 3:
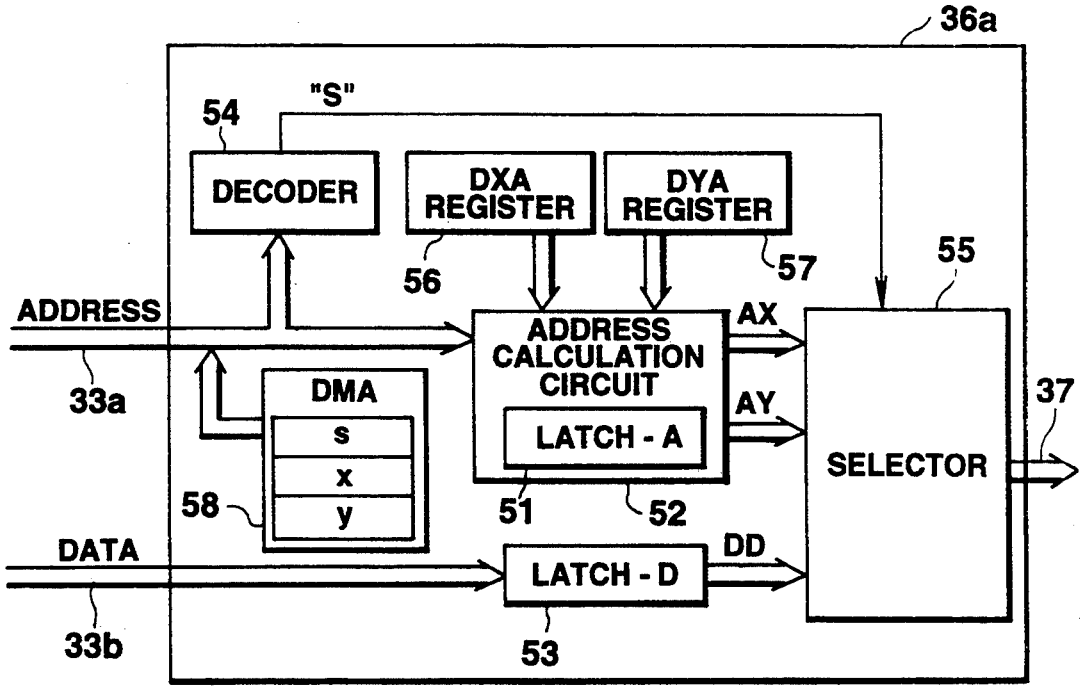
FIG. 3 is a block diagram showing details of a multiplexer of FIG. 2.

FIG. 3 shows the details of the multiplexer 36*a*.

The multiplexer 36*a* includes an address calculation circuit 52 having a latch-A 51 for temporarily holding address data from the address bus 33*a*, and a latch-D 53 for temporarily holding the display data from the data bus 33*b*.

In the embodiment, the address bus 33*a* is made of a 20-bit type, and the data bus 33*b* is made of an 8-bit bus.

The address bus 33*a* is connected to a decoder 54. The decoder 54 serves to decode the upper 4 bits of address data, and output a signal S when the address data accesses to the VRAM 13*a* of the system memory 13.

Upon reception of the signal S, a selector 55 serves to output address and display data to the LCDBUS 37 in the time divisional manner. The LCDBUS 37 consists of 8-bit bus, and lower 16 bits of the address data are divided into the lower 1 byte data "AX" and the upper 1 byte data "AY".

Figure 4A:
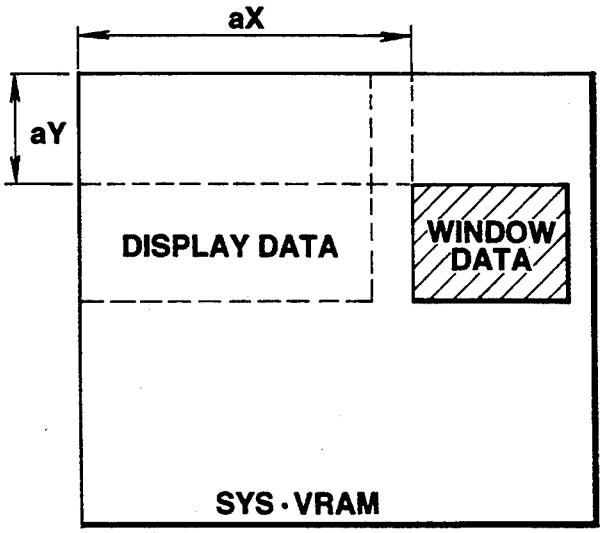
FIG. 4A is a diagram showing the structure of a VRAM of a system memory shown in FIG. 1.

It should be noted that the point of division of the address data determines the point of division in the X direction (the number of bytes in the X direction) of the memory area of the VRAM 35 of the system memory 34 as shown in FIG. 4A, and the significant bit number for the "AX" is not necessary 8 bits.

A DXA register 56 and a DYA register 57 serve to store "DXA" and "DYA", respectively, each of which is an amount of displacement resulting from addition to or subtraction from the address data stored in the latch-A 51.

The relationship between the LCD 32 and the VRAMs 40*a*, 40*b* will now be described.

The LCD 32 has a display screen consisting of display pixels arranged such that there are 160 dots in the vertical (Y) direction and 256 dots in the horizontal (X) direction.

Each of the VRAMs 40*a* and 40*b* provided respectively in the segment drivers ($D/D_{SEG}$) 38*a* and 38*b* has a memory capacity of 160×128 dots, and serves to store display data to be displayed on the screen, in a two-division manner.

The lower byte data "AX" of the address data serves to designate the selection of two segment drivers ($D/D_{SEG}$) 38*a*, 38*b* and the address of the VRAM in the X direction, whereas the upper byte data "AY" serves to designate the address in the Y direction.

The VRAM area 35 of the system memory 34 has a capacity larger than the total capacity of the VRAM 40*a* and VRAM 40*b* of the segment drivers ($D/D_{SEG}$), and includes the display data memory area corresponding to the VRAMs 40*a*, 40*b* of the segment drivers ($DD_{SEG}$).

The LCDC 36 includes a direct memory access circuit (DMA) 58, a display timing control section 36*b* and read/write control section 36*c* operating as a data collision avoidance control section.

When start address (S), the number of bytes (x) in the X direction and the number of bits (y) in the Y direction are set by the CPU 31, the DMA 58 automatically reads data having a rectangular area of x.y with respect to start address S as the starting point, from the VRAM area 35 of the system memory 34, and writes the data into the VRAM 40*a* or 40*b* of the segment driver ($DD_{SEG}$) 38*a* or 38*b*.

The display timing control section 36*b* serves to output a display timing signal necessary to drive the LCD 32 to each of the segment drivers ($D/D_{SEG}$) 38*a* and 38*b* and the common driver ($D/D_{COM}$) 39. In reply to the display timing signal, the common driver ($D/D_{COM}$) outputs a common signal, whereas each of the segment drivers ($D/D_{SEG}$) 38*a* and 38*b* outputs a segment signal in accordance with the display bit map data stored in the VRAMs 40*a* and 40*b*.

The read/write control section 36*c* functioning as the data collision avoiding control section serves to avoid the data write timing for the VRAMs 40*a*, 40*b* of the segment drivers ($D/D_{SEG}$) 38*a* and 38*b* overlapping with the data read timing for display on the LCD 32, and output a collision avoiding control signal on the basis of the timing control operation for the LCD 32 by the display timing control section 36*b* and the data write control signal output from the CPU 31.

The operation of the embodiment will now be described.

In the case where the CPU 31 operates to write display data to be displayed on the LCD 32 in the VRAM 35 of the system memory 34, a write signal is output to the R/W signal line 41, and the address and display data are output to the address and display buses 33*a* and 33*b*, respectively. Then, the display data is written in the system memory 34 in accordance with the address data.

In the LCDC 36, the address data is stored in the latch-A 51, whereas the display data is stored in the latch-D 53. At the same time, in the decoder 54, it is judged as to whether or not the address data addresses the VRAM area 35 of the system memory 34.

When it is judged that the address data addresses the VRAM area 35 of the system memory 34, the display data and the address data are time-division-output to the LCDBUS 37. More specifically, the selector 55 selectively outputs the lower byte "AX" of the address data, the upper byte "AY" stored in the latch-A 51, and the display data "DD" stored in the latch-D 53 to the LCDBUS 37 in order. The display segment drivers ($D/D_{SEG}$) 38*a*, 38*b* receive these data, and write the display data to a designated VRAM 40*a* or 40*b*.

The display data written in the VRAMs 40*a* and 40*b* of the segment drivers ($D/D_{SEG}$) 38*a* and 38*b* are read out based on the display timing signal output from the display timing control section 36*b* of the LCDC 36, and sent to the segment electrodes in the LCD 32. The display data is then synchronized with the common signal output from the common driver ($D/D_{COM}$) 39, and thus the LCD 32 is driven.

Next, the case where a window is opened on the display screen of the LCD 32 so as to display other display data in a portion of the background display data, will now be described.

Figure 4B:
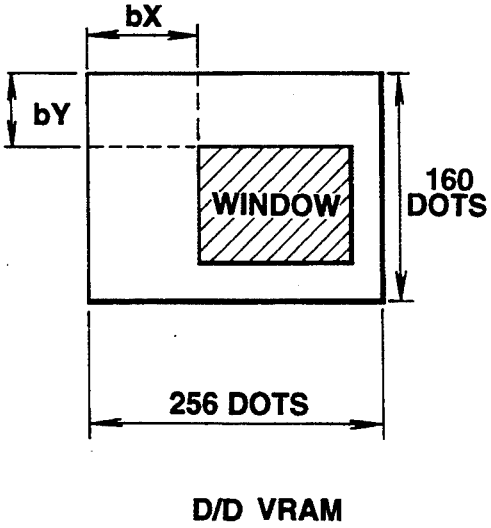
FIG. 4B is a diagram showing the structure of a VRAM of a display driver shown in FIG. 1.
Figure 5:
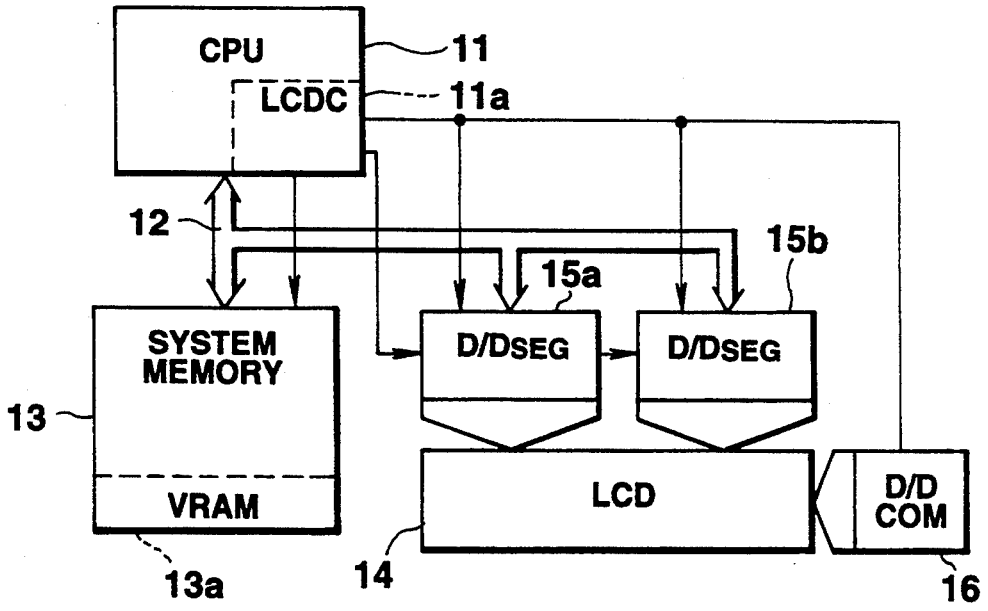
FIG.5 PRIOR ART
FIGS. 5 and 6 are block diagrams each showing a conventional circuit.
Figure 6:
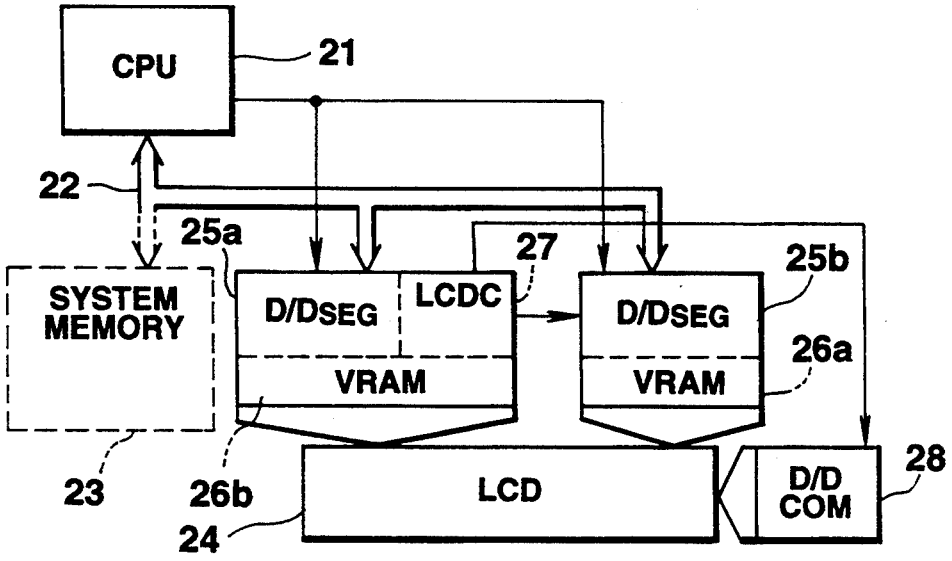
FIG.6 PRIOR ART

Let us suppose the case as shown in FIG. 4B, for example, in which window data is written from the point where the address is displaced by "bx" in the X direction and "by" in the Y direction with respect to the original address (the upper left corner of the screen of FIG. 4B) of the VRAM memory area of the segment driver, which corresponds to the LCD 32.

Window display data is written in a memory area other than the area where the display data presently displayed is stored, within the entire area of the VRAM 35 of the system memory 34, by the CPU 31. FIG. 4A illustrates data stored in the VRAM 35 in a visualized form, and the region defined by the broken lines indicates a memory area for display data. Suppose that the window display data is written to the shaded area of FIG. 4A, and the write start address thereof is set at "ax" and "ay". Then, the CPU 31 determines the values of "DXA" and "DYA" such as to satisfy the following equations:

$$ax+DXA=bx$$

$$ay+DYA=by$$

and sets the determined values to the DXA register 56 and DYA register 57, respectively. Then, the address calculation circuit 52 calculates out "AX" data by adding the "DXA" and the lower byte of the address data stored in the latch-A 51 and "AY" data by adding the "DYA" and the upper byte, and outputs the obtained "AX" and "AY" data to the segment drivers ($D/D_{SEG}$) 38*a*, 38*b* via the selector 55. The segment driver 38*a* or 38*b* stores the display data into the VRAM 40*a* or 40*b* in accordance with the address data received.

Consequently, when window data is written in by addressing a certain area in the VRAM 35 of the system memory 34, the address data and display data are transferred to the segment drives 38*a* and 38*b* via the LCDC 36, and a window is automatically displayed on the LCD 32 at the designated location.

In such an operation, as shown in FIG. 4A, the display data for the background image and that for the window are stored in different areas of the system VRAM 35, and therefore, even if a window is superimposed over a part of the current image, it is not necessary to save the background image data of the area corresponding to the location of the window.

Moreover, by utilizing the function of the DMA 58, the window display data written in the VRAM 35 of the system memory 34 and the portion of the background image data hidden behind the window can be written in the VRAM 40*a* or 40*b* of the segment driver 38*a* or 38*b*, thereby simplifying the display of a window and the recovering operation of the background image. In the case where the display data is read by the CPU 31, the data is read out directly from the system memory 34, and the LCDC 36 does not operate.

With the present invention having the above-described structure, developers of software have to consider only direct access to the VRAM in a system memory as regards the display data write process, and therefore the software designing burden can be reduced.

Lastly, the present invention is not limited to the embodiments described above, and can be modified into a variety of versions without departing from the scope thereof.

What is claimed is:

1. An electronic device comprising:

a dot matrix type display screen for displaying data;

a display driving circuit for driving said display screen;

a system memory containing a display memory area for storing data to be displayed on said display screen;

a process unit for controlling operation of said electronic device, said process unit including writing means for supplying said system memory with data together with address data to write said data at an address of said system memory designated by said address data; and a display data write control circuit for judging whether the writing means of said process unit writes data into said display memory area of said system memory, and for sending to said display driving circuit the same data as being written into said display memory area by said writing means to display said same data on said display screen, when it is determined that said writing means writes data into said display memory area of said system memory.

2. An electronic device according to claim 1, wherein said display driving circuit includes an image memory corresponding to said display screen.

3. An electronic device according to claim 1, wherein said display data write control circuit includes means for judging whether or not address data which is supplied to said system memory by said writing means is to designate addresses in said display memory area of said system memory to judge whether the writing means of said process unit writes data into said display memory area of said system memory.

4. An electronic device according to claim 3, wherein said display data write control circuit includes sending means for sending said display data and said address data to said display driving circuit.

5. An electronic device according to claim 4, wherein:

said display screen includes a liquid crystal display device; and said display driving circuit includes a segment drive circuit having an image memory corresponding to said display screen and a common signal generating circuit.

6. An electronic device according to claim 5, wherein said display data write control circuit includes a direct memory access controller for sending data storage in said display memory area of said system memory to said image memory.

7. An electronic device according to claim 5, wherein said display data write control circuit includes means for varying said address data by a predetermined displacement amount and sending the varied address data to said display driving circuit.

8. A display device comprising:

a display unit, having a display screen for displaying display data;

a first memory for storing the display data displayed on said display screen;

a second memory having a memory area a predetermined part of which is determined as a display data storing area;

write means for writing the display data in said second memory;

a detector for detecting that a data writing operation by said write means is directed to said display data storing area of said second memory; and write control means for controlling writing of said display data in said first memory when the data writing operation of said display data is detected by said detector.

9. A display device according to claim 8, wherein:

said write means further includes means for supplying said address data and said display data in said second memory; and said detector includes means for judging whether or not said address data is directed within a certain range corresponding to said display data storing area.

10. A display device according to claim 9, wherein said first memory is included in a display driving circuit.

11. A display device according to claim 10, wherein:

said display screen of said display unit includes a liquid crystal display screen; and said display driving circuit includes a segment driver for said liquid crystal display screen.

12. A display device according to claim 10, wherein: said write control means further includes sending means for sending said display data and address data to said display driving circuit; and said display driving circuit includes means for writing said sent display data in said first memory on the basis of said address data sent by said sending means.

13. A display device according to claim 12, wherein said write control means further includes operation means for adding or subtracting a predetermined value to or from said address data.

14. A display memory control device comprising:

a display screen;

a display driving circuit for driving said display screen;

a first memory, included in said display driving circuit and addressed by two types of address data as for X and Y directions, for storing display data corresponding to said display screen;

a second memory directly accessed by a CPU, said second memory having an area not less than that of said first memory, for storing the display data;

a third memory for storing a displacement amount value;

an address data processor for adding or subtracting said displacement amount value stored in said third memory to or from said address data when the CPU carried out a write operation to said second memory; and control means for outputting said address data processed by said address data processor to said first memory.

15. A display memory control device according to claim 14, further comprising Judging means for judging whether or not said area of said second memory for storing the display data is to be accessed.

16. A display memory control device according to claim 15, wherein:

said address data contains upper bit data indicating an X addressing direction and lower bit data indicating a Y addressing direction; and said third memory includes means for storing said displacement amount value of each of the X and Y direction components.

17. A display memory control device according to claim 14, wherein;

addresses of said display data storing area in said second memory correspond to addresses of said first memory; and said display memory control device further comprises:

means for addressing an area other than the display data storing area of said second memory to store window data;

means for setting a displacement amount value to said third memory to write window display data to a predetermined memory location of said first memory;

and means for displaying a window in accordance with the window display data.

18. A display memory control device according to claim 14, wherein:

said display screen includes a liquid crystal display device; and said first memory is included in a segment driver chip.

* * * * *